US010267119B2

(12) United States Patent
Hazel

(10) Patent No.: US 10,267,119 B2
(45) Date of Patent: Apr. 23, 2019

(54) DOWNHOLE WELL SYSTEM

(71) Applicant: Welltec Oilfield Solutions AG, Zug (CH)

(72) Inventor: Paul Hazel, Aberdeen (GB)

(73) Assignee: Welltec Oilfield Solutions AG, Zug (CH)

( * ) Notice: Subject to any disclaimer, the term of this patent is extended or adjusted under 35 U.S.C. 154(b) by 90 days.

(21) Appl. No.: 15/322,876

(22) PCT Filed: Jun. 29, 2015

(86) PCT No.: PCT/EP2015/064758
§ 371 (c)(1),
(2) Date: Dec. 29, 2016

(87) PCT Pub. No.: WO2016/001174
PCT Pub. Date: Jan. 7, 2016

(65) Prior Publication Data

US 2017/0159405 A1 Jun. 8, 2017

(30) Foreign Application Priority Data

Jun. 30, 2014 (EP) ..... 14174986

(51) Int. Cl.
*E21B 34/08* (2006.01)
*E21B 33/127* (2006.01)
(Continued)

(52) U.S. Cl.
CPC ..... *E21B 34/08* (2013.01); *E21B 33/1243* (2013.01); *E21B 33/1277* (2013.01);
(Continued)

(58) Field of Classification Search
CPC .. E21B 34/08; E21B 33/1243; E21B 33/1277; E21B 34/066; E21B 43/12; E21B 43/14; E21B 47/06
See application file for complete search history.

(56) References Cited

U.S. PATENT DOCUMENTS 7,980,306 B2 7/2011 Lovell et al.

FOREIGN PATENT DOCUMENTS

CN 101718182 A 6/2010
CN 202417488 U 9/2012
(Continued)

OTHER PUBLICATIONS

International Search Report and Written Opinion of the ISA for PCT/EP2015/064758 dated Sep. 2, 2015, 11 pages.
(Continued)

*Primary Examiner* — Yong-Suk Ro
(74) *Attorney, Agent, or Firm* — Nixon & Vanderhye P.C.

(57) ABSTRACT

A downhole well system for producing hydrocarbon-containing fluid from a reservoir downhole includes a well tubular structure having first and second annular barriers for isolating an annulus outside the well tubular structure. Each annular barrier has a tubular part adapted to be mounted as part of the well tubular structure, the tubular part having an outer face, an expandable metal sleeve surrounding the tubular part, and an annular space between the inner sleeve face of the expandable sleeve and the tubular part. An inflow valve assembly is arranged between the first and the second annular barriers for providing fluid communication between the production zone and the inside of the well tubular structure through a passage in the inflow valve assembly by adjusting a closing member in relation to the passage.

18 Claims, 9 Drawing Sheets

(51) Int. Cl.

| | |
|---|---|
| ***E21B 34/06*** | (2006.01) |
| ***E21B 43/14*** | (2006.01) |
| ***E21B 33/124*** | (2006.01) |
| ***E21B 43/12*** | (2006.01) |
| ***E21B 47/06*** | (2012.01) |

(52) U.S. Cl.
CPC ..... *E21B 34/066* (2013.01); *E21B 43/12* (2013.01); *E21B 43/14* (2013.01); *E21B 47/06* (2013.01)

(56) References Cited

FOREIGN PATENT DOCUMENTS

| | | | | |
|---|---|---|---|---|
| EP | 2 479 376 | | 7/2012 | |
| EP | 2479376 | A1 * | 7/2012 | ..... E21B 33/127 |
| RU | 2 391 502 | C2 | 6/2010 | |
| RU | 2 409 736 | C1 | 1/2011 | |
| SU | 1716097 | A1 | 2/1992 | |
| WO | WO 2001/65063 | | 9/2001 | |
| WO | WO 0165063 | A1 * | 9/2001 | ..... E21B 43/12 |
| WO | WO 2013/109285 | | 7/2013 | |

OTHER PUBLICATIONS

Extended Search Report for EP14174986.1 dated Dec. 18, 2014, 6 pages.
English Translation of the Notification of the First Office Action dated Aug. 1, 2018 in Chinese Application No. 201580031824.8 (7 pages).
Office Action of Substantive Examination dated Feb. 4, 2019 in Russian Application No. 2017100408/03(000731) with English translation (14 pages).

* cited by examiner

DOWNHOLE WELL SYSTEM

This application is the U.S. national phase of International Application No. PCT/EP2015/064758 filed 29 Jun. 2015 which designated the U.S. and claims priority to EP Patent Application No. 14174986.1 filed 30 Jun. 2014, the entire contents of each of which are hereby incorporated by reference.

FIELD OF THE INVENTION

The present invention relates to a downhole well system for producing hydrocarbon-containing fluid from a reservoir downhole. Further, the present invention relates to an inflow regulation method for adjusting the inflow of fluid in the downhole well system according to the invention.

BACKGROUND ART

When producing hydrocarbon-containing fluid from a reservoir from different production zones, the inflow of fluid is adjusted if e.g. a production zone is producing too much water or the pressure in one zone is much lower than a pressure in another zone. Such adjustment is mainly performed by submerging a tool into the well, and when the tool is opposite the inflow valve to be adjusted, the tool engages the valve and opens or closes the valve. Another way of adjusting the inflow is to have control lines on the outside of the metal casing, so that the valves can be adjusted from surface.

Adjusting the valves by submerging a tool into the well takes time, and adjusting the valves through control lines or flow lines jeopardises the well safety as the lines are to run through the main barriers at the top of the well, inducing the potential risk of a leak and thus of a blow-out. Therefore, attempts have been made to design autonomous valves, e.g. having swellable elements reacting to water or valves lowering the pressure of the fluid using a vortex principle if the water content of the fluid is too high. However, none of these autonomous valves is sufficiently reliable, as they do not always function as intended, and the adjustment of some of the valves is irreversible.

SUMMARY OF THE INVENTION

It is an object of the present invention to wholly or partly overcome the above disadvantages and drawbacks of the prior art. More specifically, it is an object to provide an improved inflow valve assembly capable of being reversibly adjusted without using control lines or a separate tool.

The above objects, together with numerous other objects, advantages and features, which will become evident from the below description, are accomplished by a solution in accordance with the present invention by a downhole well system for producing hydrocarbon-containing fluid from a reservoir downhole, comprising:

- a well tubular structure having an inside,
- a first and a second annular barrier for isolating an annulus outside the well tubular structure, each annular barrier comprising:
  - a tubular part adapted to be mounted as part of the well tubular structure, the tubular part having an outer face,
  - an expandable metal sleeve surrounding the tubular part and having an inner sleeve face facing the tubular part and an outer sleeve face facing a wall of a borehole, each end of the expandable sleeve being connected with the tubular part, and
  - an annular space between the inner sleeve face of the expandable sleeve and the tubular part, the first and second annular barriers being adapted to isolate a production zone when expanded, and

- an inflow valve assembly arranged between the first and the second annular barriers opposite the production zone for providing fluid communication between the production zone and the inside of the well tubular structure through a passage in the inflow valve assembly by adjusting a closing member in relation to the passage, wherein the inflow valve assembly comprises a sensor unit comprising:

- a sensor adapted to measure at least one property of the fluid,
- a power supply for powering at least the sensor, and
- a control unit for activating the adjustment of the closing member based upon the measurement of the sensor.

The tubular part may be a tubular metal part.

Moreover, the well tubular structure may be a well tubular metal structure.

Also, the well tubular metal structure may be arranged in the borehole, the well tubular metal structure having an outer face facing the wall of the borehole.

Additionally, the downhole well system may be a single-cased completion comprising one well tubular metal structure.

Furthermore, the well tubular metal structure may have a substantially unrestricted inner diameter. Said inner diameter may be restricted by less than 10%.

The well tubular metal structure may comprise at least one production opening opposite the production zone, providing fluid communication between the annulus and the inside of the well tubular metal structure, and the inflow valve assembly may be fluidly controlling the flow of fluid through the production opening.

Further, the first annular barrier and the second annular barrier may be configured to be expanded to fluidly isolate the production zone.

By having a sensor unit having the sensor, the power supply as well as the control unit, no wiring from surface or other means for supplying electricity to the sensor is needed. It has been attempted in some known systems to use the casing to conduct the electric power, but tests have shown that the sensors are then failing and data communication from the sensor unit is impossible.

Also, the sensor may be arranged outside the well tubular structure or in the well tubular structure.

The sensor may be a flow rate sensor, a pressure sensor, a capacitance sensor, a resistivity sensor, an acoustic sensor, a temperature sensor or a strain gauge.

Moreover, the property may be pressure, density, capacitance, resistivity, flow rate, water content or temperature.

Furthermore, the sensor may be adapted to measure the property of fluid outside the well tubular structure.

Outside the well tubular metal structure may be between the well tubular metal structure and a borehole in which the well tubular metal structure is arranged.

In addition, the sensor may face the borehole.

Also, the sensor may be adapted to measure the property of fluid inside the well tubular structure.

Said sensor may be adapted to measure a pressure inside and in the annulus. Further, the sensor unit may comprise a three-port valve having a first port in fluid communication with the annulus, a second port in fluid communication with the inside of the well tubular structure, and a third port fluidly connected with the sensor so as to bring the sensor in fluid communication with either the annulus or the inside for measuring a property of a fluid in the annulus and a property of a fluid in the inside, respectively.

In addition, the three-port valve may be adapted to switch between a first position fluidly connecting the first port with the third port and a second position fluidly connecting the second port with the third port.

The sensor unit may be an insert which may be inserted in an opening in the well tubular structure adjacent the inflow valve assembly.

Also, the sensor may be adapted to measure a pressure inside the well tubular structure, and the system may further comprise a second sensor adapted to measure a pressure in the annulus.

Furthermore, the second sensor may be adapted to measure the pressure in the annulus outside the well tubular structure and isolated by the first and second annular barriers.

Additionally, the sensor may be adapted to measure a temperature inside the well tubular structure, and the system may further comprise a second sensor adapted to measure a temperature outside the well tubular structure.

Moreover, the closing member may be a sliding sleeve.

Further, the inflow valve assembly may comprise a valve having the closing member.

In addition, the valve may be a throttle valve, a magnetic valve, a solenoid valve or a check valve, such as a ball check valve, disc check valve, swing check valve, or the like.

Furthermore, the sensor may be arranged for measuring upstream of the passage, in the passage or downstream of the passage.

Additionally, the inflow valve assembly may comprise several sensors.

Said inflow valve assembly may have one sensor arranged for measuring upstream of the passage and one sensor arranged for measuring downstream of the passage.

Moreover, the control unit may comprise a processor for comparing the measurement with a preselected property range.

Also, the inflow valve assembly may comprise a plurality of passages.

The downhole well system as described above may further comprise a plurality of inflow valve assemblies.

Further, a second sensor may be arranged in the annular space for measuring a pressure of the fluid in the annular space, the control unit being adapted to open the passage if the measured pressure in the annular space is lower than a pressure of the fluid in the production zone.

The sensor unit may comprise a communication module.

Furthermore, the sensor unit may comprise a Radio Frequency Identification (RFID) tag.

Moreover, the system may further comprise a downhole tool for loading data from the sensor unit.

The communication modules of the downhole tool and the sensor unit may communicate via an antenna, induction, electromagnetic radiation or telemetry.

Also, the sensor unit may comprise an antenna.

Additionally, the sensor unit may comprise a transducer adapted for recharging the power supply of the sensor unit.

Further, the recharging may be by means of radio frequency, acoustics, electromagnetic radiation.

The system may further comprise a database, so that the data can be stored in the database, whereby the data can be assessed and used to follow the development of the well/reservoir in the different annulus and zones, and the data may be compared with the actual production of hydrocarbon-containing fluid from the well, so that the data can be used for optimising the production of the same well, or other wells.

Moreover, the downhole tool may comprise a surface read-out module.

Said downhole tool may comprise an activation means adapted to remotely activate the sensor unit.

Also, the downhole tool may comprise a driving unit, such as a downhole tractor.

Furthermore, the inflow valve assembly may comprise a storage module such as a CPU, a memory or a recording unit.

Moreover, the power supply may be rechargeable.

In addition, the inflow valve assembly may comprise a turbine or propeller for providing power.

Also, the inflow valve assembly may comprise a generator driven by the turbine or propeller.

Further, the sensor may be adapted to measure the property at predetermined intervals or continuously.

The downhole well system as described above may further comprise a plurality of first and second annular barriers for isolating a plurality of production zones.

Furthermore, an inflow valve assembly may be arranged opposite each production zone for adjusting the flow of fluid from the production zone.

The present invention also relates to an inflow regulation method for adjusting the inflow of fluid in the downhole well system as described above, comprising the steps of

- measuring a property of the fluid by the sensor,
- determining if the measurement is inside or outside a preselected property range, and
- activating adjustment of the closing member if the measurement is outside the range.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
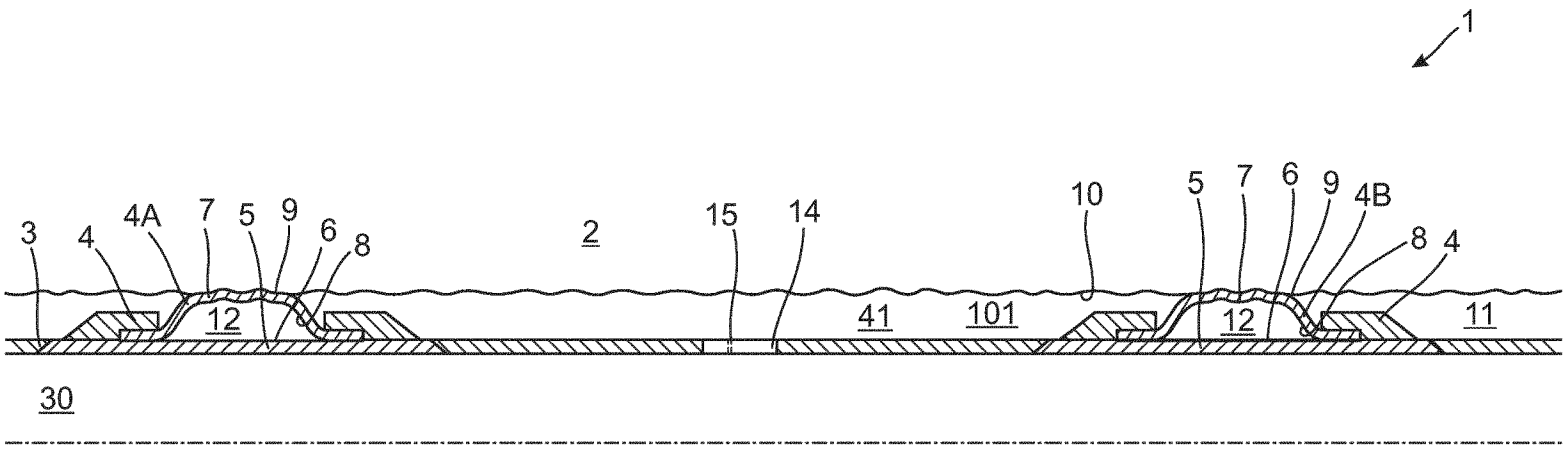
FIG. 1 shows a cross-sectional view of a downhole well system.

FIG. 1 shows a downhole well system 1 for producing hydrocarbon-containing fluid from a reservoir 2 downhole. The downhole well system 1 comprises a well tubular structure 3 having an inside 30 for conducting the well fluid to surface. The downhole well system 1 comprises a first annular barrier 4, 4A and a second annular barrier 4, 4B to isolate an annulus 41 outside the well tubular structure to form a production zone 101 when the annular barriers are expanded. Each annular barrier comprises a tubular part 5 adapted to be mounted as part of the well tubular structure by means of a thread 51 (shown in FIG. 2), an expandable metal sleeve 7 surrounding the tubular part and an annular space 12 between the inner sleeve face of the expandable sleeve and the tubular part. The expandable metal sleeve 7 has an inner sleeve face 8 facing the tubular part and an outer sleeve face 9 facing a wall 10 of a borehole 11, each end of the expandable sleeve being connected with the tubular part, which provides the isolating barrier when the expandable sleeve is expanded. The downhole well system 1 further comprises an inflow valve assembly 14 mounted as part of the well tubular structure and arranged between the first and the second annular barriers opposite the production zone for providing fluid communication between the production zone and the inside of the well tubular structure through a passage 15 in the inflow valve assembly by adjusting a closing member 16 (shown FIG. 2) in relation to the passage.

Figure 2:
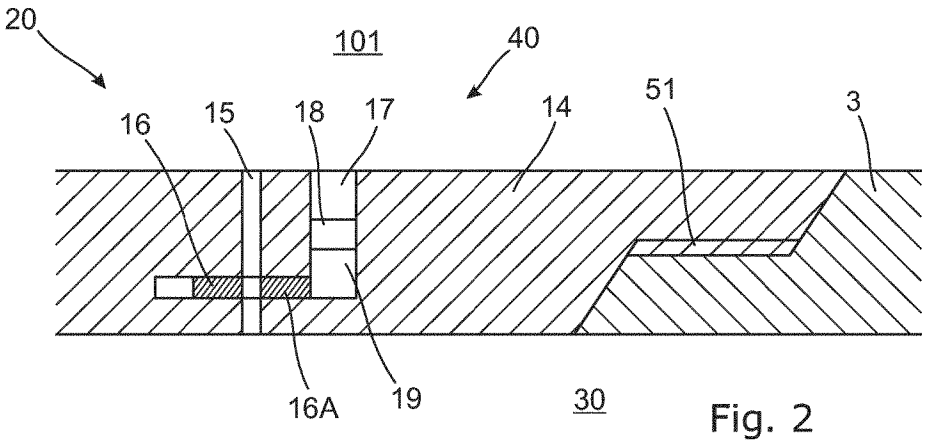
FIG. 2 shows a cross-sectional view of an inflow valve assembly.

The inflow valve assembly 14 shown in FIG. 2 comprises a sensor unit 40 having a sensor 17 adapted to measure at least one property of the fluid. The sensor is powered by a power supply 18, and the inflow valve further comprises a control unit 19 for activating the adjustment of the closing member 16 based upon the measurement of the sensor, so as to open, choke or close the passage 15 and thereby control the passage of fluid into the inside 30 of the well tubular structure 3 from the production zone 101.

The sensor 17 is a flow rate sensor, a pressure sensor, a capacitance sensor, a resistivity sensor, an acoustic sensor, or a temperature sensor for measuring a fluid property such as pressure, density, capacitance, resistivity, flow rate, water content or temperature. By having a sensor in the inflow valve assembly, the inflow valve assembly can close or choke itself without the need of control signals from surface if e.g. the production zone is producing too much water. The power supply may be a small battery which may be rechargeable by inserting a tool into the well.

Figure 3:
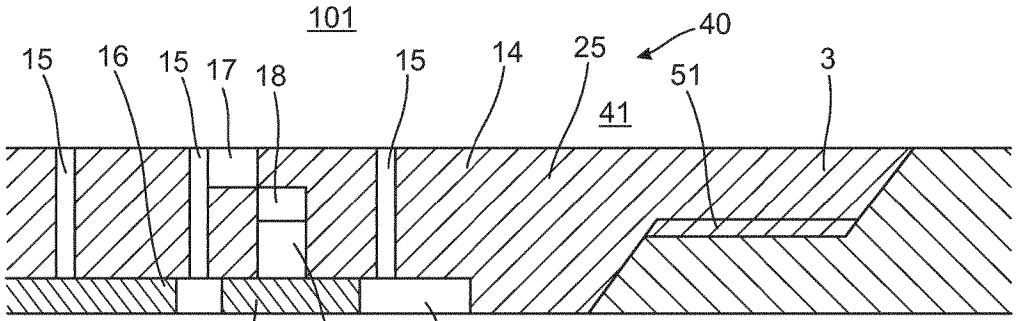
FIG. 3 shows a cross-sectional view of another inflow valve assembly.
Figure 4:
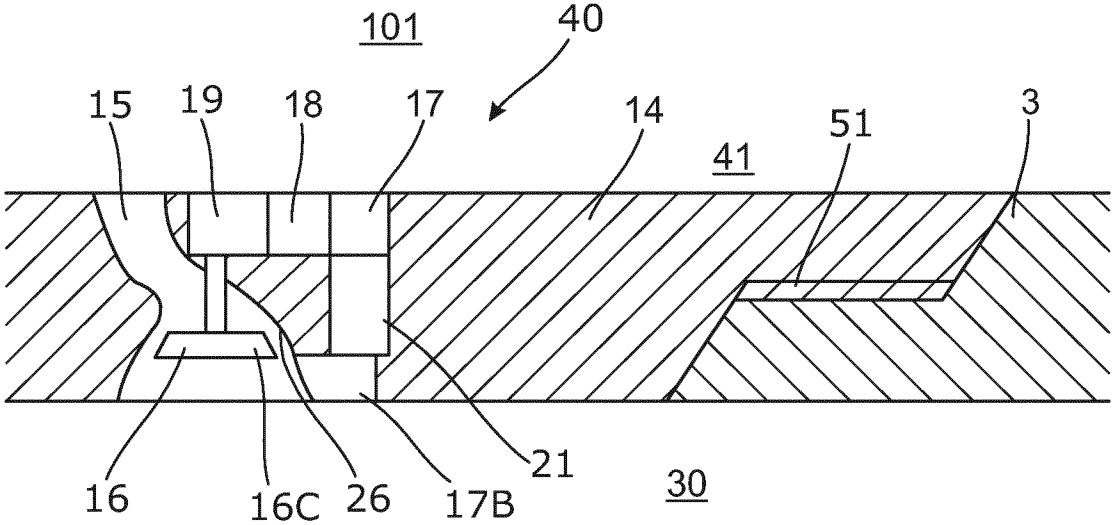
FIG. 4 shows a cross-sectional view of yet another inflow valve assembly.

In FIG. 2, the closing member 16 is a valve slide bar 16A slid and controlled by the control unit 19. In FIG. 3, the closing member 16 is a sliding sleeve 16B slidable in a groove 24 in the tubular part 25 of the inflow valve assembly 14. Thus, the inflow valve assembly may comprise a valve 20 having the closing member 16 in the form of a cone 16C, as shown in FIG. 4, closing against a valve seat 26. In other embodiments, the valve may be a throttle valve, a magnetic valve, a solenoid valve or a check valve, such as a ball check valve, disc check valve, swing check valve, or the like.

The sensor 17 may be arranged for measuring upstream of the passage 15 as shown in FIG. 2, or arranged for measuring in the passage as shown in FIG. 3, or arranged for measuring downstream of the passage as shown in FIG. 4. By measuring both upstream and downstream of the closing member 16 as shown in FIG. 4, the result of the choking can quickly be determined and the inflow valve assembly thus further adjusted if required. The control unit comprises a processor 21 for this purpose and for comparing the measurement with a preselected property range, so that the inflow valve assembly is adjusted if the measured property is outside the range. The inflow valve assembly may comprise several sensors measuring different properties of the fluid, so that one measured property can be confirmed by another measurement. Hence if e.g. the water content increases, the capacity measurement is capable of detecting such change, and if the temperature is also measured to drop, the increasing water content is thus confirmed. Likewise, if the gas content increases, which can be measured by the capacitance measurement, this can be confirmed by a pressure measurement.

Figure 7:
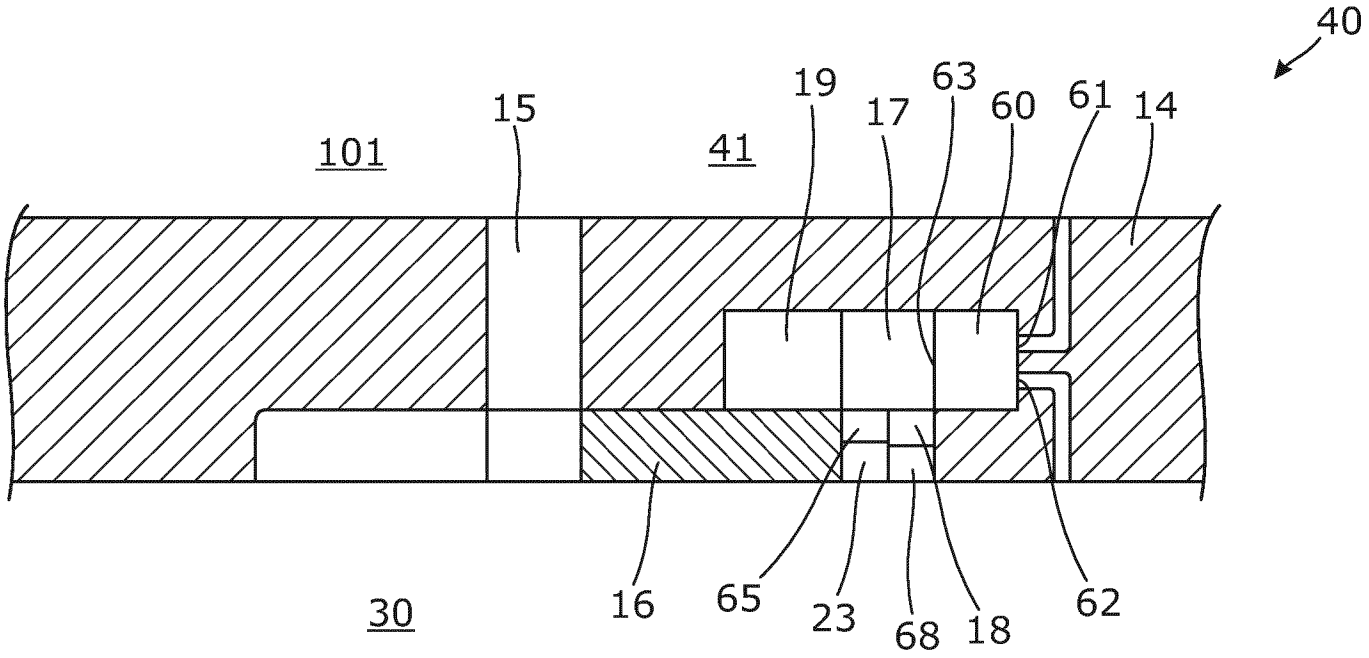
FIG. 7 shows a cross-sectional view of yet another inflow valve assembly having one sensor measuring both inside and outside the well tubular structure.

In order to follow the development of the reservoir, the measurements and adjustments performed by the inflow valve assembly may be stored in a storage module such as a CPU, a memory or a recording unit and a communication module 23 (as shown in FIG. 7) for communicating these data to e.g. a tool submerged into the well.

As shown in FIG. 3, the inflow valve assembly 14 comprises a plurality of passages, some being open and others being closed. In this way, the volume flow of the fluid can be adjusted by opening or closing passages.

Figure 5:
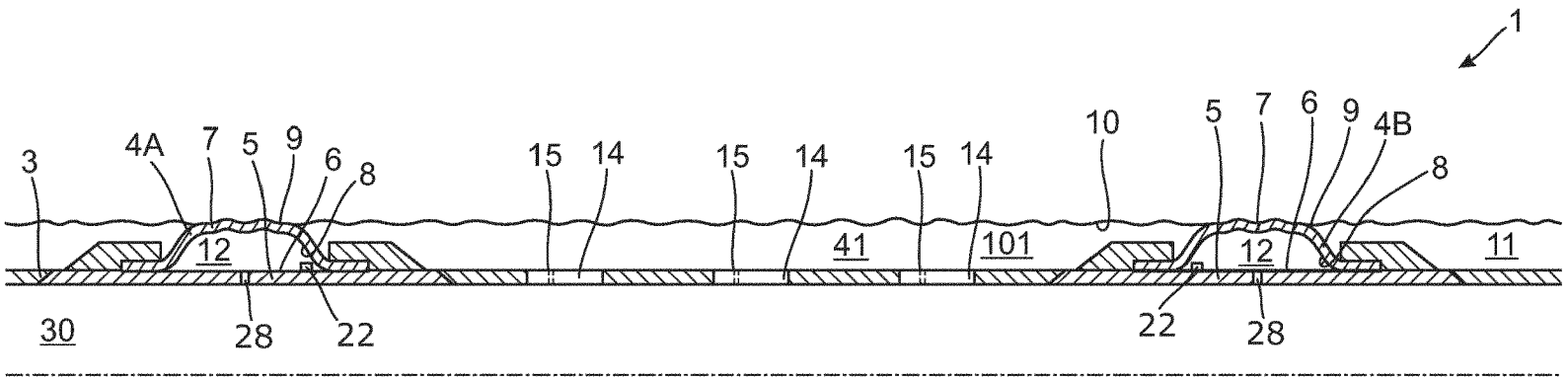
FIG. 5 shows a cross-sectional view of another downhole well system.

In FIG. 5, the downhole well system 1 comprises a plurality of inflow valve assemblies, and a second sensor 22 is arranged in the annular space 12 of the annular barriers in order to measure a pressure of the fluid in the annular space. The control unit in the inflow valve assembly closest to the second sensor is adapted to open the passage if the measured pressure in the annular space is lower than a pressure of the fluid in the production zone. This is to avoid that the pressure in the production zone causes the expandable metal sleeve of the annular barrier to collapse, and by letting more fluid into the inside 30 of the well tubular structure 3, the fluid can flow into the annular space 12 of the annular barrier through an expansion opening 28 in the tubular part of the annular barrier, hence equalising the pressure across the expandable metal sleeve. When expanding the annular barriers, the inside of the well tubular structure is pressurised, and this pressurised fluid is let into the annular space through the expansion opening 28 to expand the expandable metal sleeve 7. If the pressure outside the expandable metal sleeve increases, the pressure inside the expandable metal sleeve does not automatically follow, if the inflow valve assembly has no opening for the passage.

Figure 6:
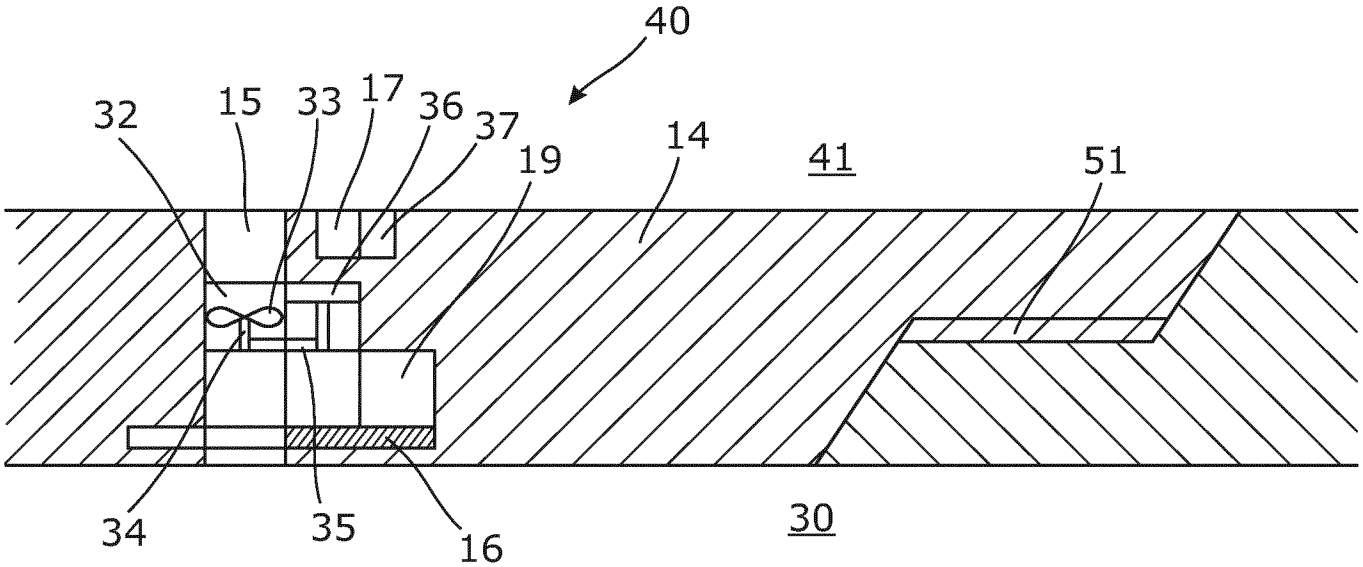
FIG. 6 shows a cross-sectional view of yet another inflow valve assembly.

As shown in FIG. 6, the inflow valve assembly 14 comprises a propeller in the passage for providing power. In this way, the battery time is prolonged since the turbine generates power when the passage is open. The propeller rotates a shaft 34 driving gears 35 which again drives a generator 36 transforming the rotational power into electricity for powering the sensor 17 and the control unit 19.

The sensor is adapted to measure the property continuously or at predetermined intervals, e.g. once a week. Therefore, the inflow valve assembly 14 may comprise a timer 37 as shown in FIG. 6.

In FIG. 7, the sensor 17 is adapted to measure both a fluid property, such as pressure, inside the well tubular structure and in the annulus 41. The sensor unit 40 comprises a three-port valve 60 having a first port 61 in fluid communication with the annulus, a second port 62 in fluid communication with the inside of the well tubular structure, and a third port 63 fluidly connected with the sensor 17 so as to bring the sensor in fluid communication with either the annulus 41 or the inside 30 in order to measure a property of a fluid in the annulus and a property of a fluid inside the well tubular structure, respectively. The three-port valve is adapted to switch between a first position fluidly connecting the first port with the third port and a second position fluidly connecting the second port with the third port.

Figure 8:
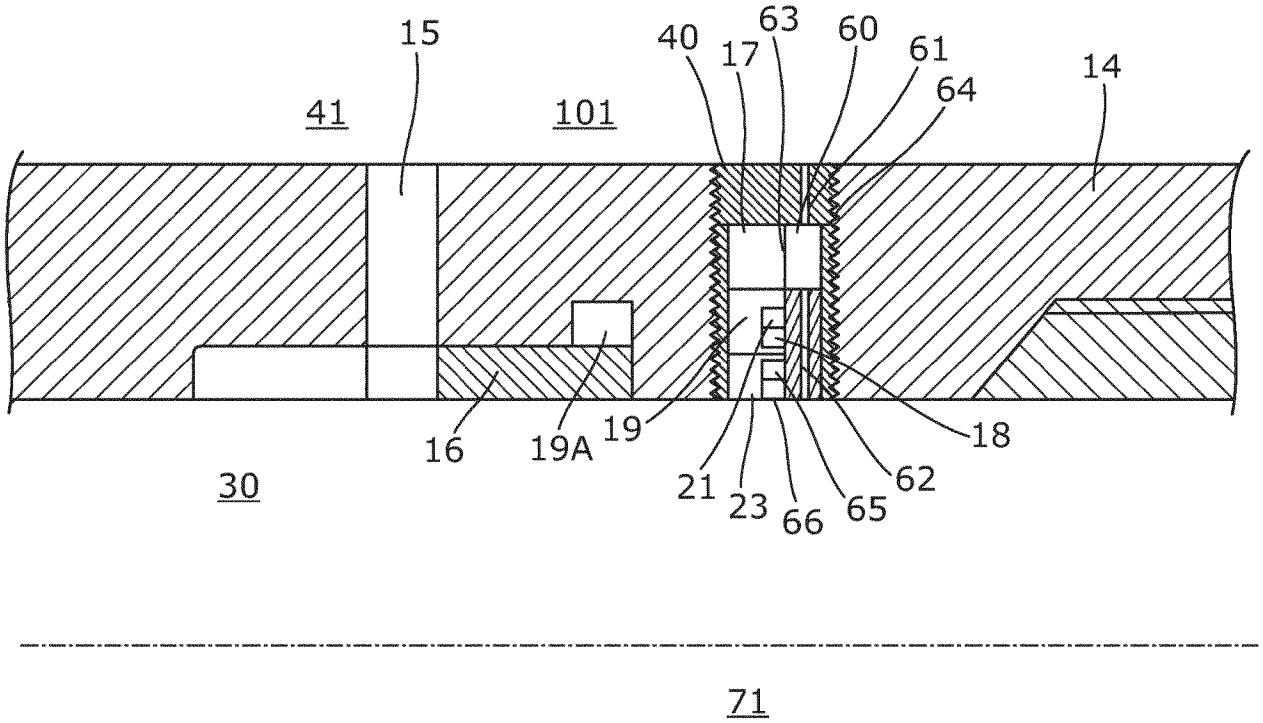
FIG. 8 shows a cross-sectional view of yet another inflow valve assembly having a sensor unit in the form of an insert.

In FIG. 8, the sensor unit is an insert which can be inserted in an opening 64 in the well tubular structure adjacent the inflow valve assembly 14. The sensor unit 40 comprises a three-port valve 60 and fluid channels providing fluid communication between the inside of the well tubular structure and the three-port valve 60, or fluid communication between the annulus and the three-port valve 60 depending on the position of the valve. The control unit 19 controls the closing member 16 through a second control unit 19A.

Figure 9:
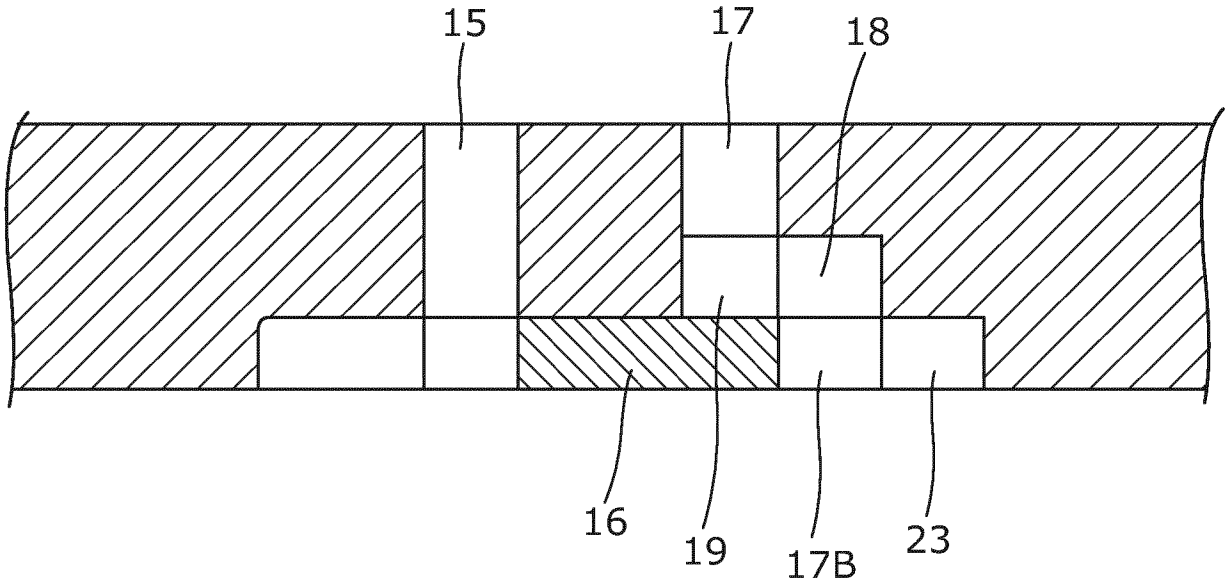
FIG. 9 shows a cross-sectional view of yet another inflow valve assembly having two sensors.

The sensor units of FIGS. 7 and 8 are adapted to measure a pressure inside or outside the well tubular structure. In another embodiment as shown in FIG. 9, the system further comprises a second sensor 17B adapted to measure the pressure in the annulus or the pressure inside the well tubular structure, so that the sensor is capable of measuring the pressure both inside by one sensor and in the annulus/production zone by the other sensor.

The sensor unit may also be adapted to measure a temperature inside the well tubular structure, and the system further comprises a second sensor adapted to measure a temperature outside the well tubular structure.

In FIG. 7, the sensor unit comprises a Radio Frequency Identification (RFID) tag 68. In FIG. 8, the sensor unit comprises an antenna 66 for communicating with an antenna of a downhole tool 71 for loading of data from the sensor unit. Thus, the communication modules of the downhole tool and the sensor unit communicate via an antenna, induction, electromagnetic radiation or telemetry. The sensor unit 40 comprises a transducer 65 adapted for recharging the power supply of the sensor unit. The recharging may be by means of radio frequency, acoustics and/or electromagnetic radiation.

The system further comprises a database (not shown), so that the data can be stored in the database, whereby the data can be assessed and used to follow the development of the well/reservoir in the different annulus and zones, and the data can be compared with the actual production of hydrocarbon-containing fluid from the well, so that the data can be used for optimising the production of the same well, or other wells. The sensor of the inflow valve assembly may measure different fluid properties of the annulus, and thus the production zone, and if these data are loaded into the database, these data along with other data from the same well or other wells can be used for a more precise prediction of the reservoir development in the future.

In order to be able to send data to surface, the downhole tool comprises a surface read-out module sending a first data set uphole, but only if changes are measured. The downhole tool may comprise an activation means adapted to remotely activate the sensor unit through the communication module or the transducer.

The adjustment of inflow of fluid in the downhole well system is performed by measuring a property of the fluid by the sensor, determining if the measurement is inside or outside a preselected property range, and then activating adjustment of the closing member if the measurement is outside the range. If the measurements are within the range, new measurements are made, e.g. after a certain period of time controlled by the timer or the control unit.

Figure 10:
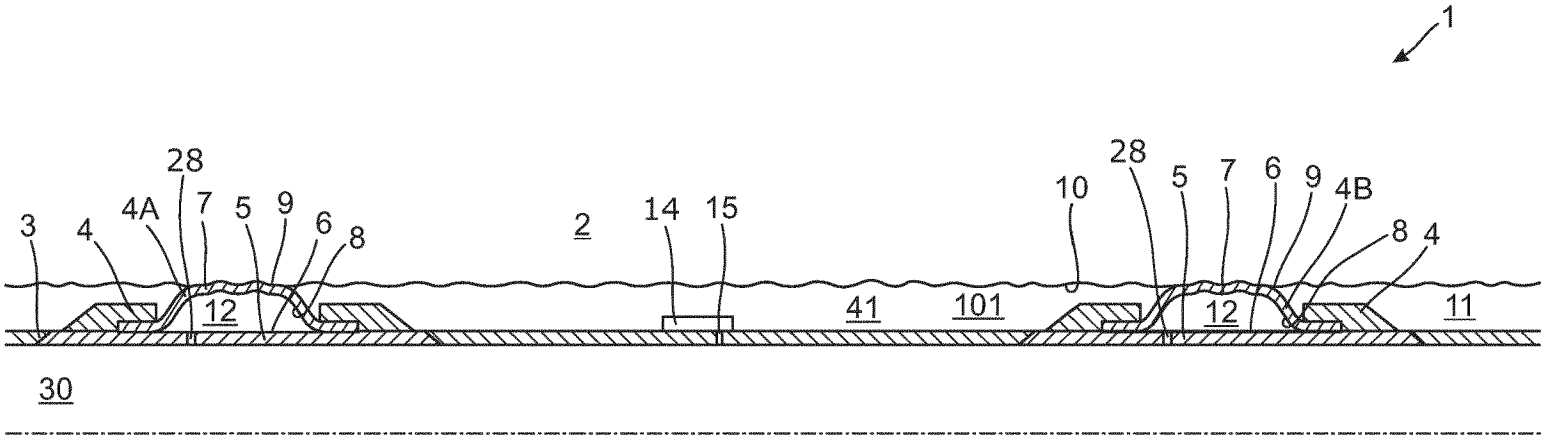
FIG. 10 shows a cross-sectional view of another downhole well system.

The tubular part may be a tubular metal part, and the well tubular structure may be a well tubular metal structure. As can be seen in FIGS. 1, 5 and 10, the well tubular metal structure is arranged in the borehole, and the well tubular metal structure has an outer face 6 facing the wall 10 of the borehole 41.

Furthermore, the downhole well system is a single-cased completion, meaning that the well tubular metal structure comprises only one well tubular metal structure and therefore has no inner production casing. Said well tubular metal structure has a substantially unrestricted inner diameter, meaning that the inner diameter of the well tubular metal structure is restricted by less than 10% and thus vary in the inner diameter by less than 10%.

As shown, the well tubular metal structure comprises at least one production opening, which is the passage 15, opposite the production zone 101, providing fluid communication between the annulus or borehole 41 and the inside 30 of the well tubular metal structure. The inflow valve assembly is fluidly controlling the flow of fluid through the production opening 15.

The first annular barrier and the second annular barrier are configured to be expanded to fluidly isolate the production zone.

By having a sensor unit having the sensor, the power supply as well as the control unit, no wiring from surface or other means for supplying electricity to the sensor is needed. It has been attempted in some known systems to run wires down to the sensors, but then the valves cannot be arranged particularly deep in the well. Other solutions use the casing to conduct the electric power, but tests have shown that the sensors are then failing and data communication from the sensor unit is impossible.

In the downhole well system according to the present invention, the sensor may be arranged outside the well tubular structure or in the well tubular structure. Also, the sensor may be adapted to measure the property of fluid outside the well tubular structure.

Outside the well tubular metal structure should be interpreted as between the well tubular metal structure and the borehole in which the well tubular metal structure is arranged. Further, the sensor may face the wall of the borehole and may be adapted to measure the property of fluid inside the well tubular structure.

In FIG. 10, the inflow valve assembly 14 is arranged on the outer face 6 of the well tubular metal structure and between the first annular barrier and the second annular barrier opposite the production zone, providing fluid communication between the production zone and the inside of the well tubular structure through a passage 15 in the well tubular metal structure by adjusting the closing member in relation to the passage.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production casing or well tubular structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole well system for producing hydrocarbon-containing fluid from a reservoir downhole, comprising:

a well tubular structure having an inside, a first and a second annular barrier for isolating an annulus outside the well tubular structure, each annular barrier comprising:

a tubular part adapted to be mounted as part of the well tubular structure, the tubular part having an outer face, an expandable metal sleeve surrounding the tubular part and having an inner sleeve face facing the tubular part and an outer sleeve face facing a wall of a borehole, each end of the expandable sleeve being connected with the tubular part, and an annular space between the inner sleeve face of the expandable sleeve and the tubular part, the first and second annular barriers being adapted to isolate a production zone when expanded, and an inflow valve assembly mounted as part of the tubular structure, the inflow valve assembly being arranged between the first and the second annular barriers opposite the production zone for providing fluid communication between the production zone and the inside of the well tubular structure through a passage in the inflow valve assembly by adjusting a closing member in relation to the passage, the closing member being mounted on the well tubular structure, wherein the inflow valve assembly comprises a sensor unit comprising:

a sensor adapted to measure at least one property of the fluid, a power supply for powering at least the sensor, and a control unit for activating the adjustment of the closing member based upon the measurement of the sensor.

2. The downhole well system according to claim 1, wherein the sensor is arranged outside the well tubular structure or in the well tubular structure.

3. The downhole well system according to claim 1, wherein the sensor is a flow rate sensor, a pressure sensor, a capacitance sensor, a resistivity sensor, an acoustic sensor, a temperature sensor or a strain gauge.

4. The downhole well system according to claim 1, wherein the property is pressure, density, capacitance, resistivity, flow rate, water content or temperature.

5. The downhole well system according to claim 1, wherein the sensor is adapted to measure the property of fluid outside the well tubular structure.

6. The downhole well system according to claim 1, wherein the sensor is adapted to measure a pressure inside the well tubular structure, and the system further comprises a second sensor adapted to measure a pressure in the annulus.

7. The downhole well system according to claim 1, wherein the inflow valve assembly comprises a valve having the closing member.

8. The downhole well system according to claim 1, wherein the inflow valve assembly comprises several sensors.

9. The downhole well system according to claim 1, wherein the control unit comprises a processor for comparing the measurement with a preselected property range.

10. The downhole well system according to claim 1, wherein the inflow valve assembly comprises a plurality of passages.

11. The downhole well system according to claim 1, wherein a second sensor is arranged in the annular space for measuring a pressure of the fluid in the annular space, the control unit being adapted to open the passage upon receiving an indication that the measured pressure in the annular space is lower than a pressure of the fluid in the production zone.

12. The downhole well system according to claim 1, wherein the sensor unit comprises a communication module.

13. The downhole well system according to claim 1, wherein the power supply is rechargeable.

14. The downhole well system according to claim 1, wherein the sensor is adapted to measure the property at predetermined intervals or continuously.

15. The downhole well system according to claim 1, further comprising a plurality of first and second annular barriers for isolating a plurality of production zones.

16. The downhole well system according to claim 15, wherein an inflow valve assembly is arranged opposite each production zone for adjusting the flow of fluid from the production zone.

17. An inflow regulation method for adjusting the inflow of fluid in the downhole well system according to claim 1, comprising:

measuring a property of the fluid by the sensor, comparing the measurement to a preselected property range, and activating adjustment of the closing member upon receiving an indication that the measurement is outside the range.

18. The downhole well system according to claim 1, wherein the sensor, the power supply and the control unit are mounted as part of the tubular structure.

* * * * *